US011355852B2

(12) United States Patent
Leung et al.

(10) Patent No.: US 11,355,852 B2
(45) Date of Patent: Jun. 7, 2022

(54) WIDEBAND OMNIDIRECTIONAL DIELECTRIC RESONATOR ANTENNA

(71) Applicant: City University of Hong Kong, Kowloon (HK)

(72) Inventors: Kwok Wa Leung, Kowloon (HK); Zhen-Xing Xia, Kowloon (HK); Kai Lu, New Territories (HK)

(73) Assignee: City University of Hong Kong, Kowloon (HK)

( * ) Notice: Subject to any disclaimer, the term of this patent is extended or adjusted under 35 U.S.C. 154(b) by 0 days.

(21) Appl. No.: 16/928,426

(22) Filed: Jul. 14, 2020

(65) Prior Publication Data

US 2022/0021121 A1 Jan. 20, 2022

(51) Int. Cl.

| | |
|---|---|
| ***H01Q 9/04*** | (2006.01) |
| ***H01Q 1/36*** | (2006.01) |
| ***H01Q 1/48*** | (2006.01) |

(52) U.S. Cl.

CPC ..... *H01Q 9/0485* (2013.01); *H01Q 1/36* (2013.01); *H01Q 1/48* (2013.01)

(58) Field of Classification Search

CPC ..... H01Q 1/24–38; H01Q 9/0485

See application file for complete search history.

(56) References Cited

U.S. PATENT DOCUMENTS

| | | | | |
|---|---|---|---|---|
| 6,995,713 | B2 | 2/2006 | Le Bolzer et al. | |
| 7,663,553 | B2 | 2/2010 | Chang et al. | |
| 7,667,666 | B2 | 2/2010 | Chang et al. | |
| 8,179,330 | B2 | 5/2012 | Waltho | |
| 9,906,202 | B1 | 2/2018 | Lovejoy, Jr. et al. | |
| 10,008,776 | B2 | 6/2018 | Chen et al. | |
| 10,381,744 | B1 | 8/2019 | Bank | |
| 10,483,640 | B1 | 11/2019 | Issa et al. | |
| 2017/0125908 | A1* | 5/2017 | Pance | B29C 64/10 |
| 2019/0089056 | A1* | 3/2019 | Leung | H01Q 13/18 |
| 2019/0221926 | A1* | 7/2019 | Pance | H01Q 15/08 |

* cited by examiner

*Primary Examiner* — Hasan Z Islam

(74) *Attorney, Agent, or Firm* — Renner, Kenner, Greive, Bobak, Taylor & Weber

(57) ABSTRACT

A dielectric resonator antenna and a dielectric resonator antenna array. The dielectric resonator antenna includes a ground plane, a dielectric resonator element operably coupled with the ground plane, and a feed network operably coupled with the dielectric resonator element for exciting the dielectric resonator antenna to provide a wideband omnidirectional response. The dielectric resonator element includes a plurality of portions, including, at least, an innermost portion and an outermost portion arranged around the innermost portion. The innermost portion has a first effective dielectric constant and outermost portion has a second, different effective dielectric constant.

35 Claims, 10 Drawing Sheets

WIDEBAND OMNIDIRECTIONAL DIELECTRIC RESONATOR ANTENNA

TECHNICAL FIELD

The invention relates to a wideband omnidirectional dielectric resonator antenna and a related dielectric resonator antenna array. The invention also relates to their method of making. The invention also relates to a communication device incorporating the wideband omnidirectional dielectric resonator antenna or the dielectric resonator antenna array.

BACKGROUND

Wideband omnidirectional antennas can generally provide a large signal coverage so they are generally more suitable for indoor communication applications.

Dielectric resonator antenna is a good candidate for wideband omnidirectional antenna. Existing wideband omnidirectional dielectric resonator antenna is formed by a ring-shaped dielectric resonator antenna and a quarter-wavelength monopole.

There remains a need to provide an improved or an alternative dielectric resonator antenna that can provide wideband omnidirectional response (radiation pattern) in one or more applications.

SUMMARY OF THE INVENTION

In a first aspect of the invention, there is provided a dielectric resonator antenna including a ground plane, a dielectric resonator element operably coupled with the ground plane, and a feed network operably coupled with the dielectric resonator element for exciting the dielectric resonator antenna to provide a wideband omnidirectional response (radiation pattern). The dielectric resonator element includes a plurality of portions, which includes, at least, an innermost portion and an outermost portion arranged around the innermost portion. The innermost portion has a first effective dielectric constant. The outermost portion includes a second, different effective dielectric constant. The dielectric resonator element may be formed by the innermost and outermost portions only, it may include additional portions. In one embodiment, the dielectric resonator antenna includes one or more additional dielectric resonator element(s).

In one embodiment of the first aspect, the outermost portion is arranged around a periphery of the innermost portion such that the outermost portion generally surrounds the periphery of the innermost portion.

In one embodiment of the first aspect, the innermost portion is a central portion.

In one embodiment of the first aspect, the innermost portion defines an axis, and the outermost portion is arranged around the innermost portion about the axis.

In one embodiment of the first aspect, the innermost portion and the outermost portion are generally concentric.

In one embodiment of the first aspect, the second effective dielectric constant is smaller than the first effective dielectric constant.

In one embodiment of the first aspect, in plan view, the innermost portion has a first outer contour and the outermost portion has a second outer contour. The first outer contour and the second outer contour are of the same type of shape and are of different sizes. The outer contour can be polygonal or rounded. For example, the outer contour can be squared, rectangular, triangular, oblong, circular, elliptical, oval, etc.

In one embodiment of the first aspect, the innermost portion has a circular or annular cross section (cylindrical outer contour), and the outermost portion has an annular cross section.

In one embodiment of the first aspect, the innermost portion and the outermost portion have different air-filling ratios. The air-filling ratios may affect the effective dielectric constant.

In one embodiment of the first aspect, the innermost portion is generally prismatic. In other words, the innermost portion is in the form of a prism, e.g., right prism. For example, the innermost portion may be in the form of an annular cylinder, a cylinder, etc.

In one embodiment of the first aspect, the outermost portion is formed by a waffle-like structure with multiple grid cells. In one embodiment of the first aspect, the grid cells of the outermost portion are of generally the same size. In one example, in plan view, the grid cells are generally squared. Grids of other shapes (e.g., rectangular, triangular) are also possible. In one embodiment of the first aspect, the grid cells are defined by walls of the same thickness.

In one embodiment of the first aspect, the innermost portion has a first height and the outermost portion has a second height larger than the first height. The height of the innermost portion may be generally constant. The height of the outermost portion may be generally constant.

In one embodiment of the first aspect, the innermost portion has a first maximum height and the outermost portion has a second maximum height larger than the first maximum height. The height of the innermost portion may vary. The height of the outermost portion may vary.

In one embodiment of the first aspect, the plurality of portions (of the dielectric resonator element) consist of, or consist essentially of, the innermost portion and the outermost portion. For example, the outermost portion is arranged directly around the innermost portion, with no intermediate portions therebetween.

In one embodiment of the first aspect, the plurality of portions (of the dielectric resonator element) further includes one or more intermediate portions arranged around the innermost portion and nested between each other (if there are multiple intermediate portions) and between the innermost portion and the outermost portion. Each of the one or more intermediate portions is arranged around a periphery of the innermost portion such that it generally surrounds the periphery of the innermost portion and is surrounded by the outermost portion. In one embodiment where there are multiple intermediate portions, one intermediate portion is one arranged around another, e.g., one generally surrounds the periphery of another.

In one embodiment of the first aspect, the respective effective dielectric constant of the one or more intermediate portions is smaller than the first effective dielectric constant and larger than the second effective dielectric constant.

In one embodiment of the first aspect, the one or more intermediate portions include multiple nested intermediate portions each having a respective effective dielectric constant. The respective effective dielectric constants may be different and may be smaller than the first effective dielectric constant and larger than the second effective dielectric constant.

In one embodiment of the first aspect, the respective effective dielectric constant decreases between each intermediate portion from the innermost portion to the outermost portion such that among all the intermediate portions the intermediate portion closest to the innermost portion has the largest effective dielectric constant and the intermediate portion closest to the outermost portion has the smallest effective dielectric constant.

In one embodiment of the first aspect, the innermost portion, the one or more intermediate portions, and the outermost portion have different air-filling ratios. The air-filling ratio may affect the effective dielectric constant.

In one embodiment of the first aspect, the innermost portion defines an axis, the one or more intermediate portions are arranged around the innermost portion about the axis, and the outermost portion is arranged around the one or more intermediate portions about the axis.

In one embodiment of the first aspect, the innermost portion, the one or more intermediate portions, and the outermost portion are generally concentric.

In one embodiment of the first aspect, in plan view the innermost portion has a first outer contour, the outermost portion has a second outer contour, and the one or more intermediate portions each has a respective outer contour. The first outer contour, the second outer contour, and the respective outer contour are of the same type of shape and are of different sizes. The respective outer contour can be polygonal or rounded. For example, the respective outer contour can be squared, rectangular, triangular, oblong, circular, elliptical, oval, etc.

In one embodiment of the first aspect, the one or more intermediate portions are each formed by a waffle-like structure with multiple grid cells. The grid cells of the same intermediate portion may be of generally the same size. In one example, in plan view the grid cells of each of the one or more intermediate portions are generally squared.

In one embodiment of the first aspect, the grid cells of the same intermediate portion are defined by walls of the same thickness, which is different from the thickness of the walls of the outermost portions. The grid cells of different intermediate portions are defined by walls of a respective thickness different from that of the grid cells in the other intermediate portions.

In one embodiment of the first aspect, the thickness of the walls of the grid cells increases from the outermost portion towards the innermost portion such that among all the outermost portion and the one or more intermediate portion, the walls of the grid cells of the outermost portion has the smallest thickness, and the walls of the grid cells of the intermediate portion furthest away from the outermost portion and closest to the innermost portion has the largest thickness.

In one embodiment of the first aspect, the outermost portion has a height higher than that of the innermost portion and the one or more intermediate portions. The one or more intermediate portions may all have the same height. The one or more intermediate portions may have the same height as the innermost portion. The height of each intermediate portion may be constant.

In one embodiment of the first aspect, the outermost portion has a maximum height higher than that of the innermost portion and that of the one or more intermediate portions. The one or more intermediate portions may all have the different heights. The one or more intermediate portions may have a different height compared to the innermost portion. The height of each intermediate portion may vary between local minimum and local maximum.

In one embodiment of the first aspect, the dielectric resonator element is integrally formed. In one embodiment of the first aspect, the dielectric resonator element is additively manufactured. For example, the dielectric resonator element is 3D printed using 3D printing techniques. The 3D printing technique may be fused deposition modelling technique. In these embodiments, the dielectric resonator element may be made with one or more materials that can be 3D printed, e.g., ceramics.

In one embodiment of the first aspect, the dielectric resonator antenna is a probe-fed antenna.

In one embodiment of the first aspect, the dielectric resonator element is arranged on the ground plane. The dielectric resonator element may be arranged directly or indirectly on the ground plane.

In one embodiment of the first aspect, the ground plane is made of aluminium. The ground plane may be generally flat. In one example, the ground plane is provided by an aluminium plate.

In one embodiment of the first aspect, in plan view an outer contour of the ground plane and an outer contour of the dielectric resonator element (of the outermost portion of the dielectric resonator element) are of the same type of shape and are of different sizes. For example, both are circular, one formed by a larger circle and the other formed by a smaller circle.

In one embodiment of the first aspect, the feed network includes a SMA connector with a coaxial feed probe inserted through a hole in the ground plane and surrounded by the innermost portion.

In one embodiment of the first aspect, the feed network is arranged to excite one or more transverse magnetic modes of the dielectric resonator antenna. The one or more transverse magnetic modes may include two or more transverse magnetic modes. The two or more transverse magnetic modes include any two or more of: $TM_{01\delta}$ mode, $TM_{02\delta}$ mode, and $TM_{03\delta}$ mode. The one or more transverse magnetic modes may include three or more transverse magnetic modes, which include $TM_{01\delta}$ mode, $TM_{02\delta}$ mode, and $TM_{03\delta}$ mode.

In a second aspect of the invention, there is provided a dielectric resonator antenna array that includes a ground plane, a plurality of dielectric resonator elements operably coupled with the ground plane, and a feed network operably coupled with the plurality of dielectric resonator elements for exciting the dielectric resonator antenna array to provide a wideband omnidirectional response. The plurality of dielectric resonator elements each comprises a plurality of portions, including, at least, an innermost portion and an outermost portion arranged around the innermost portion. The innermost portion has a first effective dielectric constant. The outermost portion has a second, different effective dielectric constant. The first effective dielectric constants of different dielectric resonator elements can be but need not be the same. The second effective dielectric constants of different dielectric resonator elements can be but need not be the same.

In one embodiment of the second aspect, the dielectric resonator elements are arranged in a regular array (evenly spaced in at least one dimension). In another embodiment of the second aspect, the dielectric resonator elements are arranged in an irregular array.

In one embodiment of the second aspect, the dielectric resonator antenna array is a phased antenna array.

In one embodiment of the second aspect, the feed network comprises a plurality of sub-networks each associated with a respective dielectric resonator element.

In one embodiment of the second aspect, the dielectric resonator elements may each be a dielectric resonator element of the first aspect.

In a third aspect of the invention, there is provided a communication device having the dielectric resonator antenna of the first aspect. The communication device may be a wireless communication device adapted for Wi-Fi operations, e.g., in the 5 GHz band. In one embodiment, the communication device may be used for other wireless operations. The communication device may be operated as a router.

In a fourth aspect of the invention, there is provided a communication device having the dielectric resonator antenna array of the second aspect. The communication device may be a wireless communication device adapted for Wi-Fi operations, e.g., in the 5 GHz band. In one embodiment, the communication device may be used for other wireless operations. The communication device may be operated as a router.

In a fifth aspect of the invention, there is provided a method of making a dielectric resonator antenna of the first aspect. The method includes processing a computer model of the dielectric resonator antenna element in the dielectric resonator antenna using a 3D printer; forming the dielectric resonator antenna element using the 3D printer; and operably connecting the dielectric resonator antenna element with the feed network and the ground plane to form the dielectric resonator antenna. The computer model may be a CAD drawing. The 3D printer may be a fused deposition modelling 3D printer.

In one embodiment of the fifth aspect, the method further includes creating a computer model of the dielectric resonator antenna element of the dielectric resonator antenna.

In one embodiment of the fifth aspect, the method further includes creating a computer model of the dielectric resonator antenna.

In a sixth aspect of the invention, there is provided a method of making a dielectric resonator antenna array of the second aspect. The method includes processing a computer model of the dielectric resonator antenna elements in the dielectric resonator antenna array using a 3D printer; forming the dielectric resonator antenna elements using the 3D printer; and operably connecting the dielectric resonator antenna elements to the feed network and the ground plane to form the dielectric resonator antenna array. The computer model may be a CAD drawing. The 3D printer may be a fused deposition modelling 3D printer.

In one embodiment of the sixth aspect, the method further includes creating a computer model of the dielectric resonator antenna elements in the dielectric resonator antenna array.

In one embodiment of the sixth aspect, the method further includes creating a computer model of the dielectric resonator antenna array.

In a seventh aspect of the invention there is provided a computer program that, when executed by a 3D printer, causes the 3D printer to produce the dielectric resonator antenna element in the dielectric resonator antenna of the first aspect or to produce one or more of the dielectric resonator antenna elements in the dielectric resonator antenna array of the second aspect. The 3D printer may be a fused deposition modelling 3D printer.

In an eighth aspect of the invention there is provided a computer model of: the dielectric resonator antenna element of the dielectric resonator antenna of the first aspect, or one or more of the dielectric resonator antenna elements in the dielectric resonator antenna array of the second aspect. The computer model may be a CAD drawing.

In a ninth aspect of the invention there is provided a computer model of the dielectric resonator antenna of the first aspect or the dielectric resonator antenna array of the second aspect. The computer model may be a CAD drawing.

In a tenth aspect of the invention there is provided a computer program product storing the computer program (codes, instructions, data, etc.) of the seventh aspect, the computer model of the eighth aspect, and/or the computer model of the ninth aspect.

In an eleventh aspect of the invention there is provided a 3D printer arranged to make the dielectric resonator antenna element of the dielectric resonator antenna of the first aspect, or one or more of the dielectric resonator antenna elements in the dielectric resonator antenna array of the second aspect. The 3D printer stores and is arranged to process a computer model of the dielectric resonator antenna element of the dielectric resonator antenna of the first aspect, or one or more of the dielectric resonator antenna elements in the dielectric resonator antenna array of the second aspect, then additively manufactures the dielectric resonator antenna element of the dielectric resonator antenna of the first aspect, or one or more of the dielectric resonator antenna elements in the dielectric resonator antenna array of the second aspect.

In a twelfth aspect of the invention there is provided the dielectric resonator antenna element in the dielectric resonator antenna of the first aspect.

In a thirteenth aspect of the invention there is provided one or more of the dielectric resonator antenna elements in the dielectric resonator antenna array of the second aspect.

Expressions such that "generally", "about", "substantially", or the like, are used, depending on context, to take into account manufacture tolerance, assembly tolerance, degradation, trend, tendency, errors, and/or the like. In the instances where these expressions are used along with a value, they may indicate plus or minus 10%, plus or minus 5%, plus or minus 2%, plus or minus 1%, etc., of the indicated value.

BRIEF DESCRIPTION OF THE DRAWINGS

Embodiments of the invention will now be described, by way of example, with reference to the accompanying drawings in which.

DETAILED DESCRIPTION

Figure 1A:
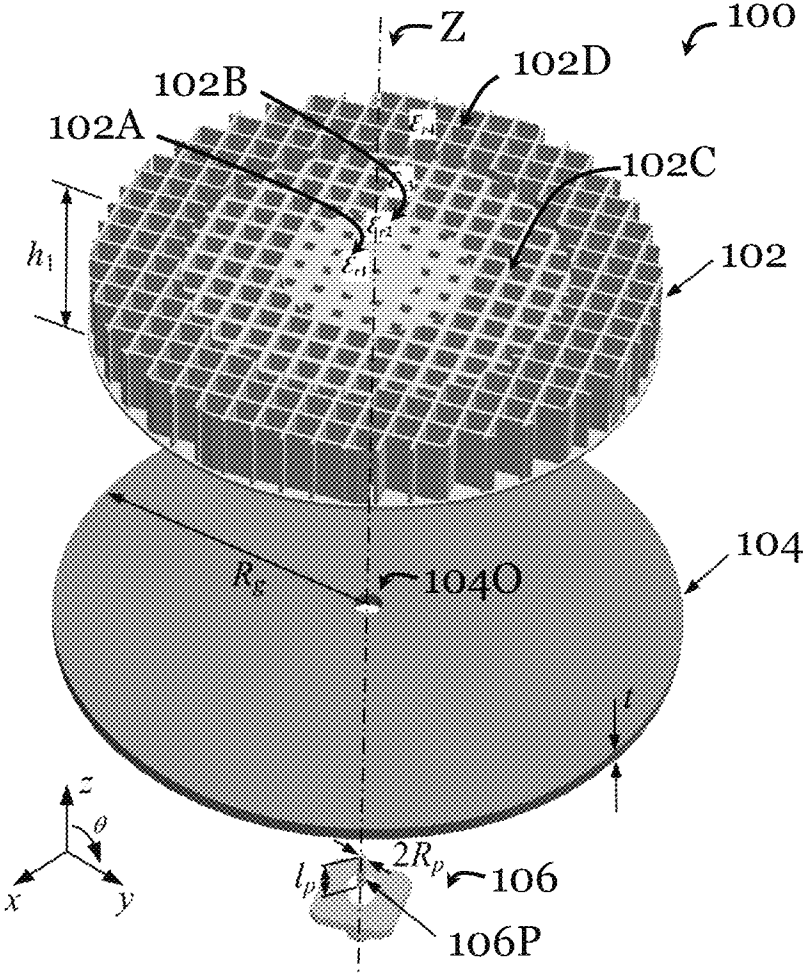
FIG. 1A is an exploded view of a dielectric resonator antenna in one embodiment of the invention.

FIG. 1A shows a dielectric resonator antenna 100 in one embodiment of the invention. The dielectric resonator antenna 100 is arranged to provide a wideband omnidirectional response (radiation pattern). Referring to FIG. 1A, the dielectric resonator antenna 100 includes a dielectric resonator element 102, a ground plane 104, and a feed network 106. The dielectric resonator element 102 is operably coupled and mounted to one side of the ground plane 104. The feed network 106 is operably coupled with the dielectric resonator element 102 and is mounted to the other side of the ground plane 104.

As shown in FIG. 1A, the dielectric resonator element 102 includes four portions, namely an innermost central portion 102A, a first intermediate portion 102B arranged around a periphery of the innermost central portion 102A, a second intermediate portion 102C arranged around a periphery of the first intermediate portion 102B, and an outermost portion 102D arrange around a periphery of the second intermediate portion 102C. The four portions 102A-102D are generally continuous with each other. The innermost central portion 102A defines an axis Z along its height. The first intermediate portion 102B, the second intermediate portion 102C, and the outermost portion 102D are all extending about the axis X. The four portions 102A-102D are arranged in a generally concentric manner. In plan view, the four portions 102A-102D have respective outer circular contours of different sizes, and they have respective annular cross sections of different sizes.

In this embodiment, the innermost central portion 102A is in the form of a solid, right annular cylinder having an annular cross section with a radius $R_1$. The first intermediate portion 102B is annular with a radius $R_2$ in plan view, and is formed by a waffle-like structure with multiple squared grid cells of generally the same size. The second intermediate portion 102C is annular with a radius $R_3$ in plan view, and is formed by a waffle-like structure with multiple squared grid cells of generally the same size. The outermost portion 102D is annular with a radius $R_4$ in plan view, and is formed by a waffle-like structure with multiple squared grid cells of generally the same size. The squared grid cells of the first intermediate portion 102B, the squared grid cells of the second intermediate portion 102C, and the squared grid cells of the outermost portion 102D are of generally the same size but with different wall thickness. In particular, the wall thickness of the grid cells of the first intermediate portion 102B is thicker than the wall thickness of the grid cells of the second intermediate portion 102C, which is in turn thicker than the wall thickness of the grid cells of the outermost portion 102D. As a result of the different wall thicknesses, the empty parts of the grid cells (the space defined by the walls) are of different sizes and the portions 102B to 102D have different air-filling ratios, which in turn leads to different effective dielectric constants. In this example, the effective dielectric constants of the innermost central portion 102A is $\varepsilon_{r1}$, the effective dielectric constants of the first intermediate portion 102B is $\varepsilon_{r2}$, the effective dielectric constants of the second intermediate portion 102C is $\varepsilon_{r3}$, the effective dielectric constants of the outermost portion 102D is $\varepsilon_{r4}$, where $\varepsilon_{r1}>\varepsilon_{r2}>\varepsilon_{r3}>\varepsilon_{r4}$. In other words, the effective dielectric constants of the dielectric resonator element 102 decrease from the innermost portion 102A towards the outermost portion 102D. The height $h_0$ of the innermost central portion 102A and the intermediate portions 102B, 102C are generally constant and the same. The height $h_1$ of the outermost portion 102D is generally constant and is higher than the height $h_0$ of the other portions 102A-102C. This increased height at the outermost portion 102D improves matching. In this embodiment the dielectric resonator element 102 is integrally formed, e.g., additively manufactured using 3D printing technique.

In FIG. 1A, the ground plane 104 is provided by a generally flat cylindrical aluminium plate. The plate has a radius $R_g$ and a thickness t. A through-hole 104O is arranged generally centrally of the plate. The feed network 106 includes a SMA connector with a coaxial feed probe 106P. The feed probe has a radius $R_p$ and a height $l_p$. The feed probe 106P extends axially through the hole 104O in the ground plane 104 and is surrounded by the dielectric resonator element 102 when assembled. Also when assembled the height of the coaxial feed probe 106P is smaller than the height of the dielectric resonator element 102. The feed probe feeds the dielectric resonator antenna 100 axially to excite its first three transverse magnetic (TM) modes: the $TM_{01\delta}$ mode, the $TM_{02\delta}$ mode, and the $TM_{03\delta}$ mode, to produce a wideband response with omnidirectional radiation patterns.

In one example, the values of the parameters are as follows: $R_1$=6 mm, $R_2$=12.5 mm, $R_3$=25.5 mm, $R_4$=37.5 mm, $\varepsilon_{r1}$=10.0, $\varepsilon_{r2}$=8.25, $\varepsilon_{r3}$=4.0, $\varepsilon_{r4}$=2.5, $h_0$=7.5 mm, $h_1$=9 mm, $l_p$=6.0 mm, $2R_p$=1.27 mm, $R_g$=44 mm, and t=2 mm.

Figure 1C:
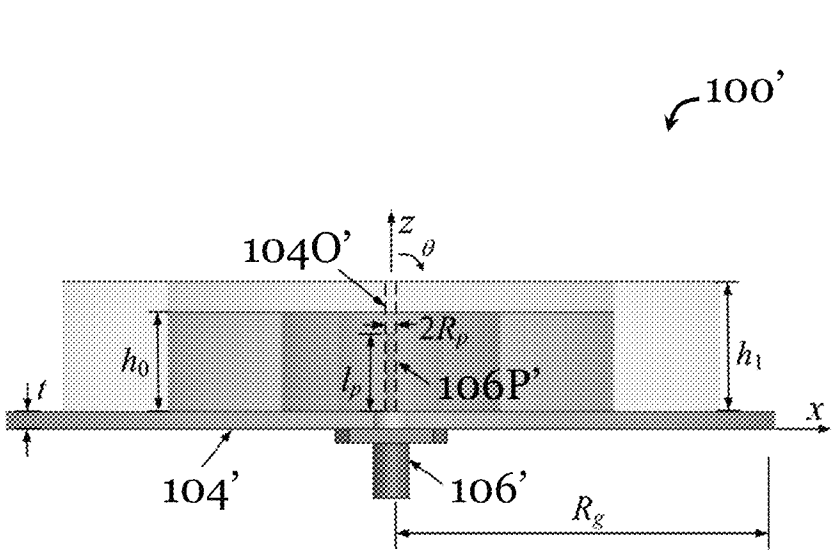
FIG. 1C is a sectional view of the conceptual solid configuration of FIG. 1B.
Figure 1B:
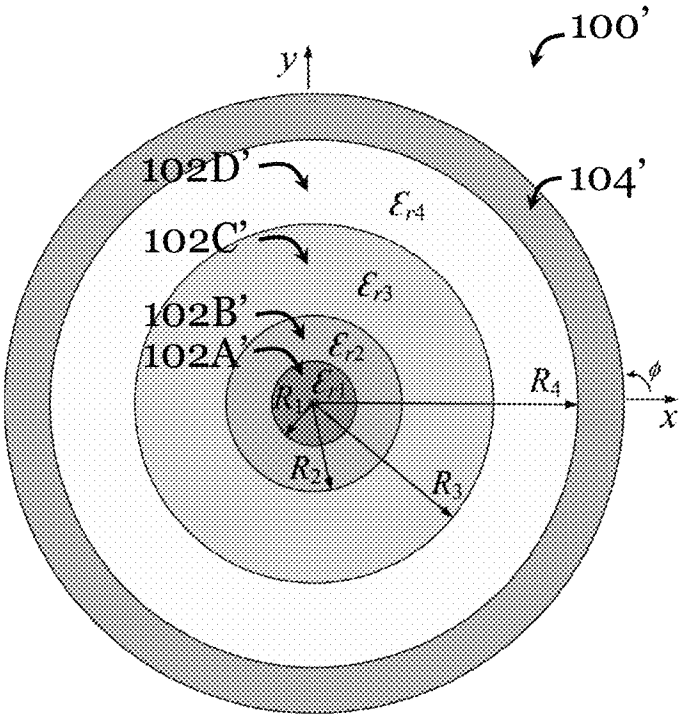
FIG. 1B is a schematic view of a conceptual solid configuration of the dielectric resonator antenna of FIG. 1A.

FIGS. 1B and 1C illustrate the conceptual solid configuration 100' of the dielectric resonator antenna 100 of FIG. 1A. The main difference between FIGS. 1B-1C and 1A is that in FIGS. 1B-1C the grid structures are omitted for simplicity. Other parts are generally the same and are numbered similarly (with an additional prime symbol). The conceptual solid configuration 100' in FIGS. 1B and 1C has been considered in the design process of the dielectric resonator antenna 100 of FIG. 1A. In one embodiment, a dielectric resonator antenna can be constructed with the solid configuration 100' illustrated in FIGS. 1B and 1C.

Figure 2:
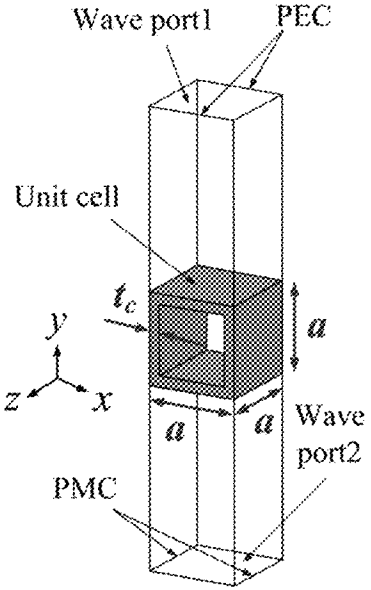
FIG. 2 is a schematic view of a unit grid cell in the dielectric resonator antenna of FIG. 1A.

FIG. 2 shows the basic construction of the grid cell unit ("unit cell") used in the portions 102B-102D. The grid cell unit is used to obtain an effective dielectric constant $\varepsilon_{eff}$ for the respective portions 102B-102D. As shown in FIG. 2, the grid cell unit is generally cubical, with a side length a and a wall thickness $t_c$. In this illustration, the side length a is fixed as 4 mm, or $0.08\lambda_0$, where $\lambda_0$ is the wavelength in air at 6 GHz. To provide a respective generally constant effective dielectric constant for each of the portions 102B-102D, the grid cell units in each of the portions 102B-102D have the same wall thickness (and the grid cell units of different portions 102B-102D have different wall thicknesses as described above). During implementation, the grid cells can physically support each other without requiring additional support. Thus, the grid cells can be additively made, e.g., 3D printed, to reduce printing time and material cost.

Figure 3:
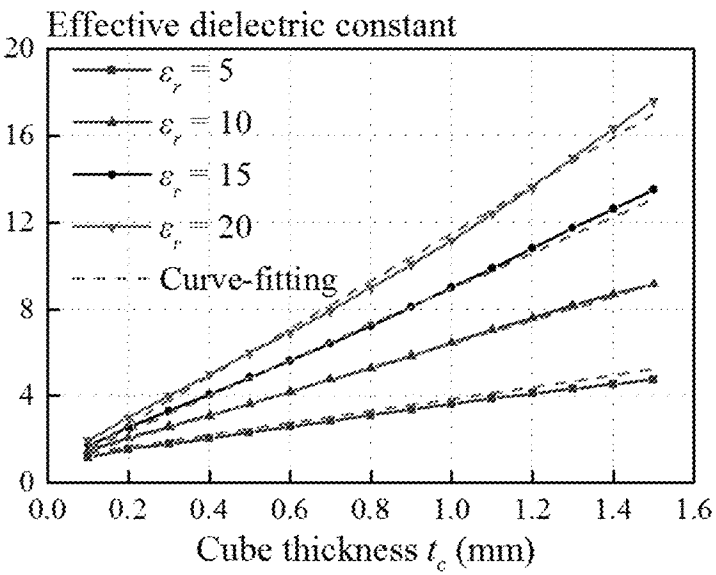
FIG. 3 is a graph showing the effective dielectric constant of different wall thicknesses of the grid cells made of different materials.

A retrieval method based on S-parameters was used to extract the effective dielectric constant $\varepsilon_{eff}$ of the grid cell unit. FIG. 3 shows the extracted $\varepsilon_{eff}$ as a function of the thickness $t_c$ for different printing materials of $\varepsilon_r$=5, 10, 15, and 20, where $\varepsilon_r$ is the dielectric constant of the material (e.g., 3D printed material). As shown in FIG. 3, $\varepsilon_{eff}$ linearly changes with $t_c$. To facilitate the design, the following curve-fitting formula of $\varepsilon_{eff}$ as a function of $t_c$ was obtained $$\varepsilon_{eff}=0.55t_c\varepsilon_r-0.04\varepsilon_r+1.3 \quad (1)$$

from which $t_c$ can be easily determined for a required $\varepsilon_{eff}$. FIG. 3 compares the results of equation (1) with the original data extracted from S-parameters. Good agreement between the curve-fitting result and original data can be observed.

Figure 4C:
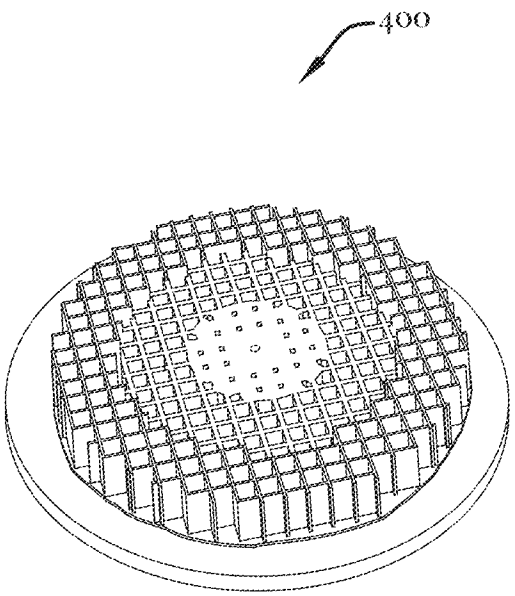
FIG. 4C is a picture showing a dielectric resonator antenna formed by the dielectric resonator antenna element of FIG. 4A coupled to the ground plane and feed network of FIG. 4B.
Figure 4B:
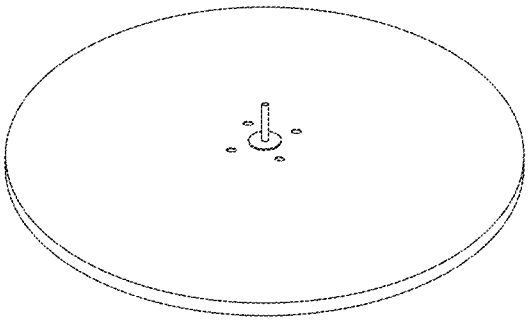
FIG. 4B is a picture showing the ground plane and feed network fabricated based on the design of the dielectric resonator antenna of FIG. 1A.
Figure 4A:
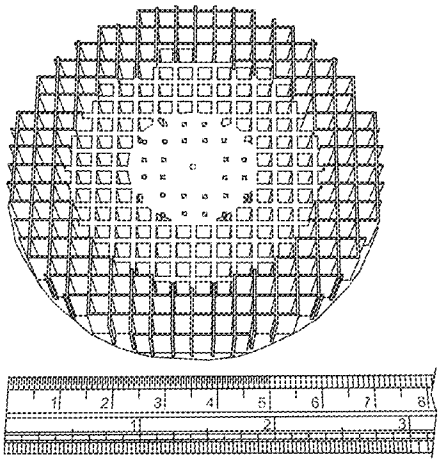
FIG. 4A is a picture showing a dielectric resonator antenna element fabricated using 3D printing based on the design of the dielectric resonator antenna of FIG. 1A.

To further test or evaluate the design in the above embodiments, a dielectric resonator antenna prototype 400 was made and tested. The prototype 400 is designed based on the antenna 100, 100' of FIGS. 1A to 1C. FIGS. 4A to 4C show the prototype 400.

In the tests performed on the prototype, the reflection coefficient was measured using an E5071C vector network analyzer; whereas the radiation pattern, the antenna gain, and the antenna efficiency were measured using a Satimo Startlab System.

Figure 5:
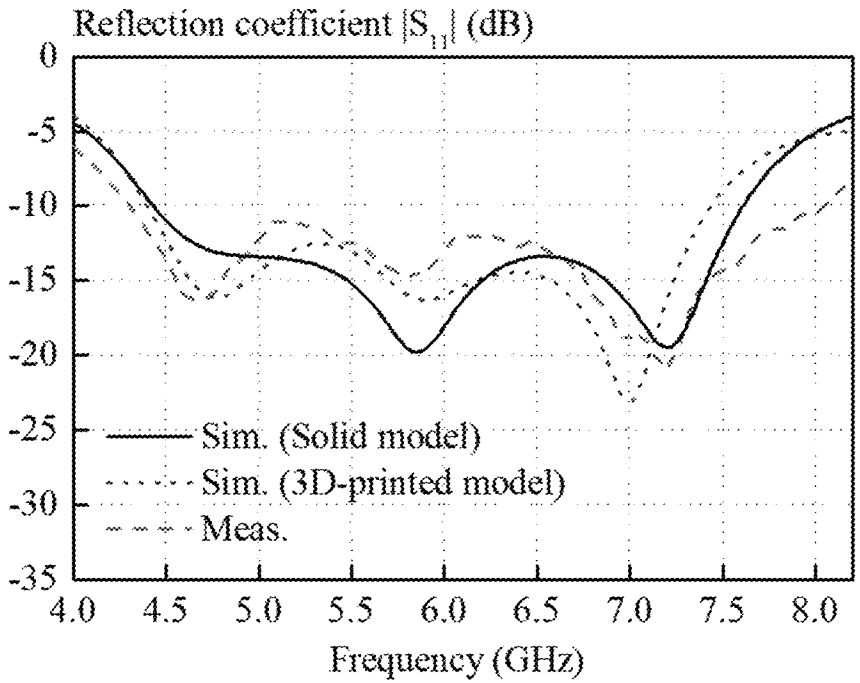
FIG. 5 is a graph showing simulated reflection coefficients of the conceptual solid configuration of FIG. 1B and simulated and measured reflection coefficients of the dielectric resonator antenna of FIG. 4C, at different frequencies.
Figures 6A, 6B:
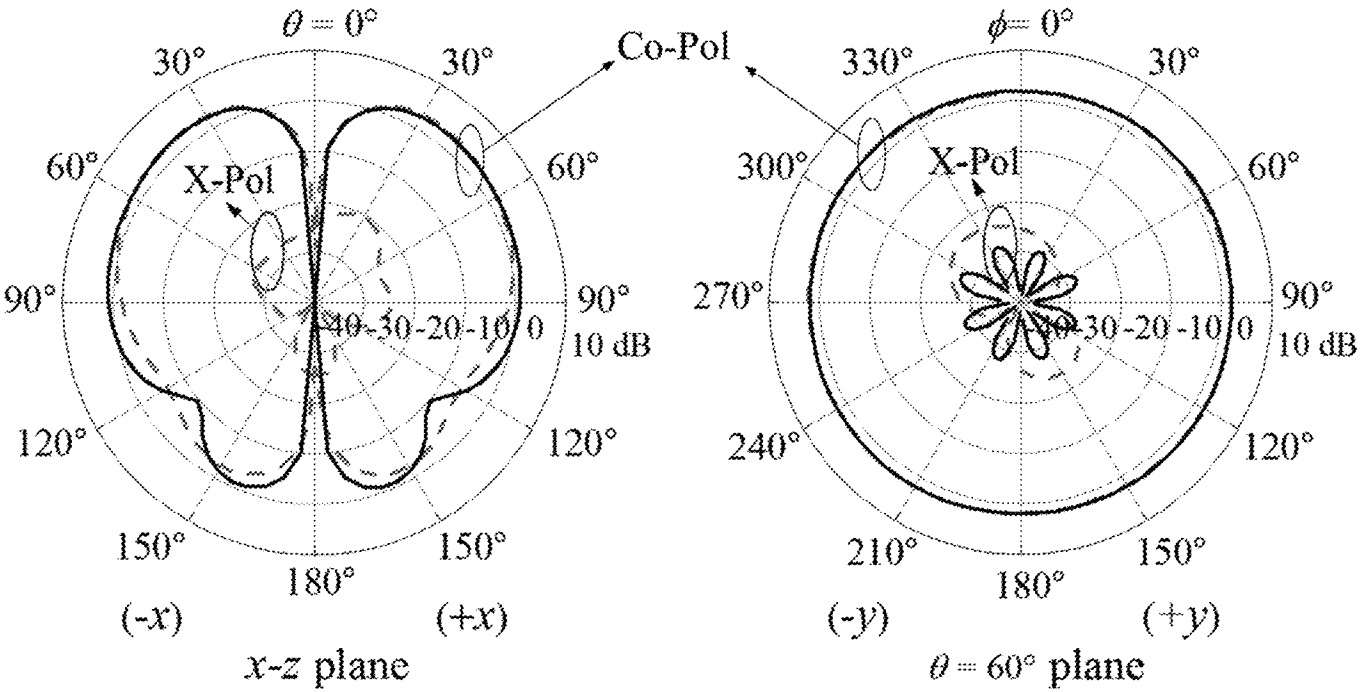
FIG. 6A is a plot showing simulated and measured radiation pattern of the dielectric resonator antenna of FIG. 4C in the elevation (x-z) plane at 4.7 GHz.
FIG. 6B is a plot showing simulated and measured radiation pattern of the dielectric resonator antenna of FIG. 4C in the azimuth (θ=60°) plane at 4.7 GHz.
Figures 7A, 7B:
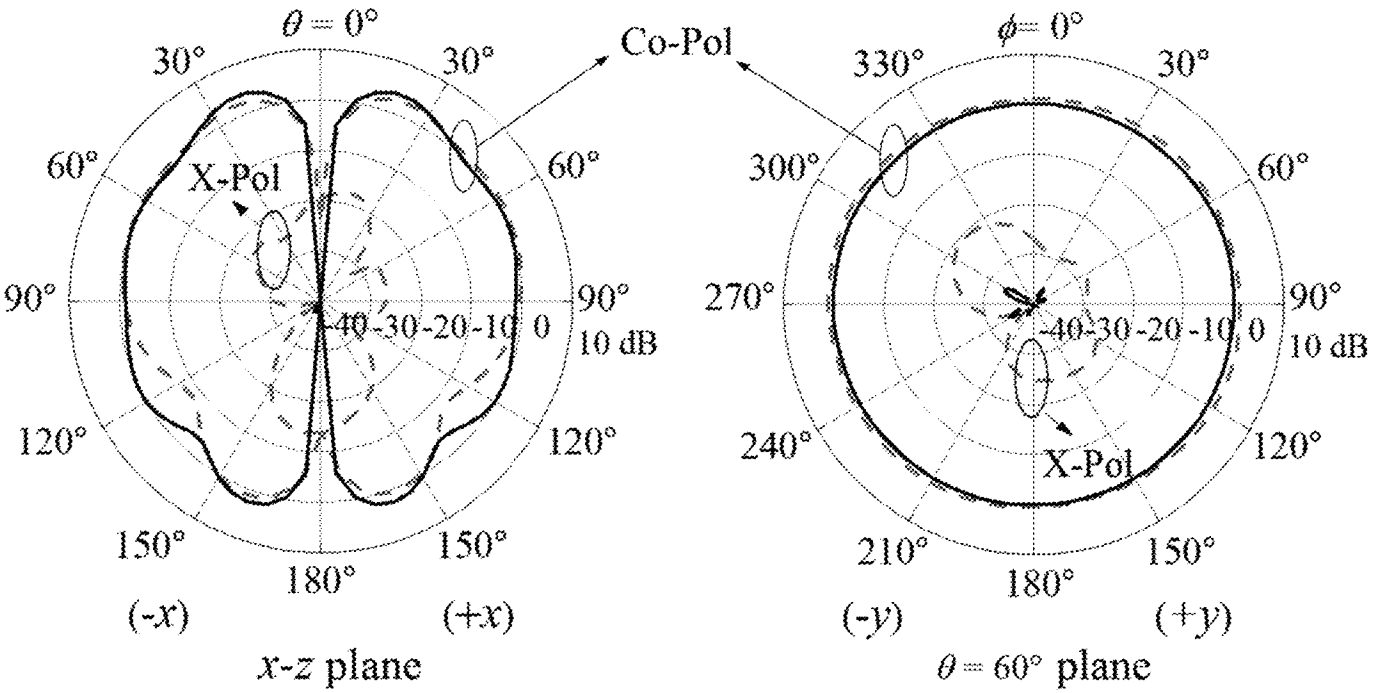
FIG. 7A is a plot showing simulated and measured radiation pattern of the dielectric resonator antenna of FIG. 4C in the elevation (x-z) plane at 5.8 GHz.
FIG. 7B is a plot showing simulated and measured radiation pattern of the dielectric resonator antenna of FIG. 4C in the azimuth (θ=60°) plane at 5.8 GHz.
Figure 8B:
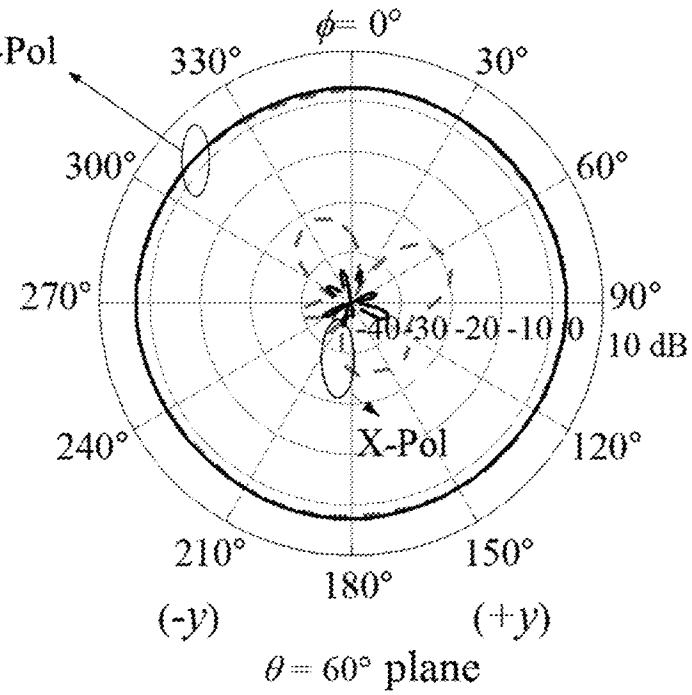
FIG. 8B is a plot showing simulated and measured radiation pattern of the dielectric resonator antenna of FIG. 4C in the azimuth (θ=60°) plane at 7.2 GHz.
Figure 8A:
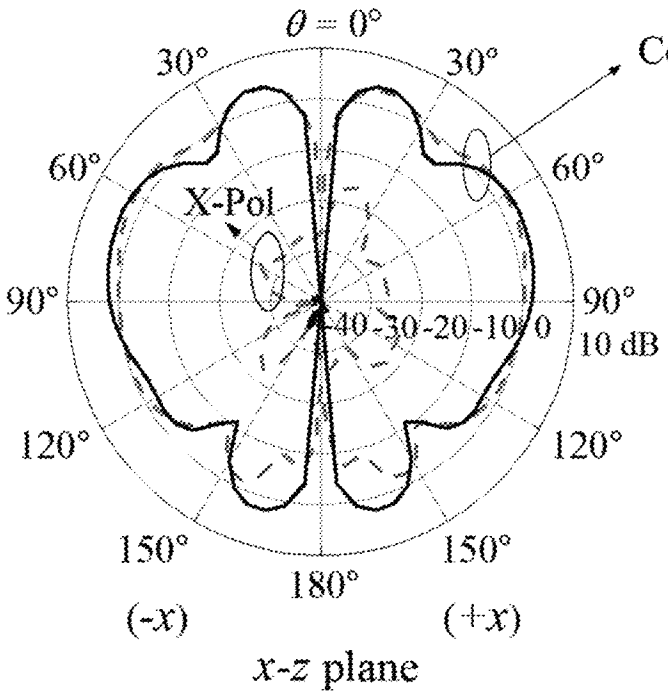
FIG. 8A is a plot showing simulated and measured radiation pattern of the dielectric resonator antenna of FIG. 4C in the elevation (x-z) plane at 7.2 GHz.

FIG. 5 shows the simulated reflection coefficient of the conceptual solid configuration 100' of FIG. 1B and simulated and measured reflection coefficients of the dielectric resonator antenna 400 of FIG. 4C, at different frequencies. As shown in FIG. 5, the simulation results of the conceptual solid configuration 100' and the dielectric resonator antenna 400 agree reasonably with each other. The discrepancy between these results is likely caused by the fact that only partial unit cells can be printed at the boundaries of the, affecting the actual value of the realized $\varepsilon_{eff}$. Nevertheless, the results show that the conceptual solid configuration 100' provides a reasonable starting point for designing a dielectric resonator antenna such as a 3D-printed dielectric resonator antenna. FIG. 5 also shows the measured and simulated reflection coefficients of the dielectric resonator antenna 400 of FIG. 4C. As shown, the measured and simulated results are in reasonable agreement, with the discrepancy caused by experimental tolerances. The measured 10-dB impedance bandwidth ($|S_{11}|\leq-10$ dB) is 60.2% (4.3-8.0 GHz), which is sufficient for 5 GHz WLAN bands (5.15-5.350 GHz & 5.725-5.875 GHz) in one example application.

FIGS. 6A to 8B show the measured and simulated radiation patterns of the dielectric resonator antenna 400 in the elevation (x-z) and azimuth ($\theta$=60°) planes at the three resonant frequencies (4.7 GHz, 5.8 GHz, and 7.2 GHz). As shown in FIGS. 6A to 8B, the conical radiation pattern is fairly stable at these frequencies. In each elevation plane, the measured co-polar field is stronger than its cross-polar counterpart by more than 20 dB. For each azimuth plane, the co-polar field is stronger than the cross-polar field by at least 18 dB. These results show that the dielectric resonator antenna 400 can provide vertically polarized radiation with good polarization purity.

Figure 9:
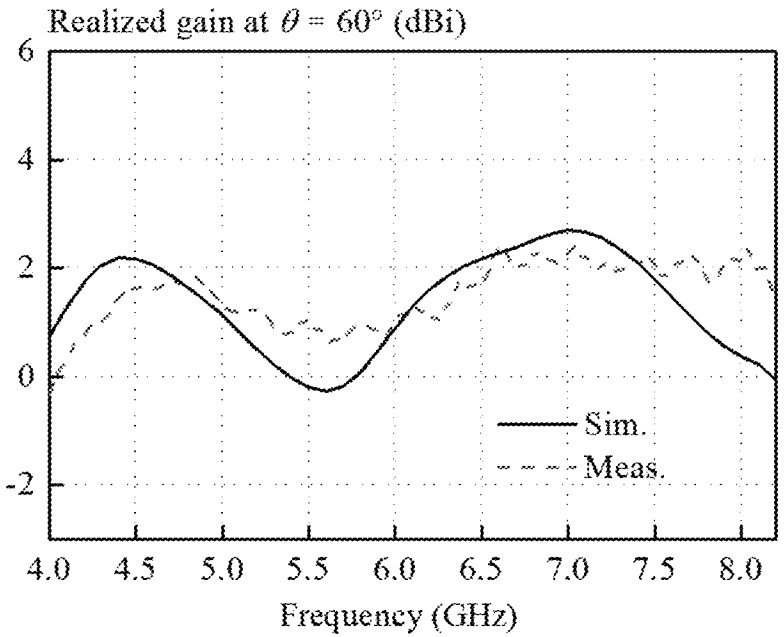
FIG. 9 is a graph showing simulated and measured antenna gains of the dielectric resonator antenna of FIG. 4C at ϕ=0° and θ=60°.

FIG. 9 shows the measured and simulated realized antenna gains of the dielectric resonator antenna 400 at $\phi$=0°, $\theta$=60°. As shown in FIG. 9, the measured result is generally in reasonable agreement with the simulated result. It can be observed that the measured gain is significantly higher than the simulated result from 7.5 GHz to 8.2 GHz. This is due to that the matching of the measured result is much better than that of the simulated result in that frequency range, as seen from the reflection coefficient in FIG. 5. The measured realized antenna gain varies between 0.65 and 2.45 dBi across the impedance passband (4.3-8.0 GHz).

Figure 10:
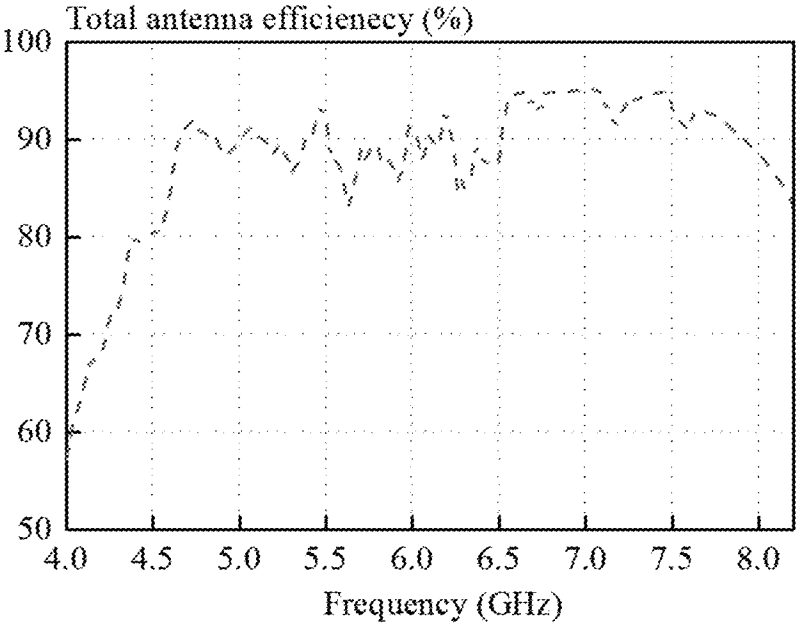
FIG. 10 is a graph showing the measured total antenna efficiency of the dielectric resonator antenna of FIG. 4C.

FIG. 10 shows the measured total antenna efficiency with impedance mismatch included. As shown in FIG. 10, the dielectric resonator antenna 400 has an average measured antenna efficiency of 89% over the impedance passband (4.3-8.0 GHz), with the peak antenna efficiency being as high as 95%.

Figure 11:
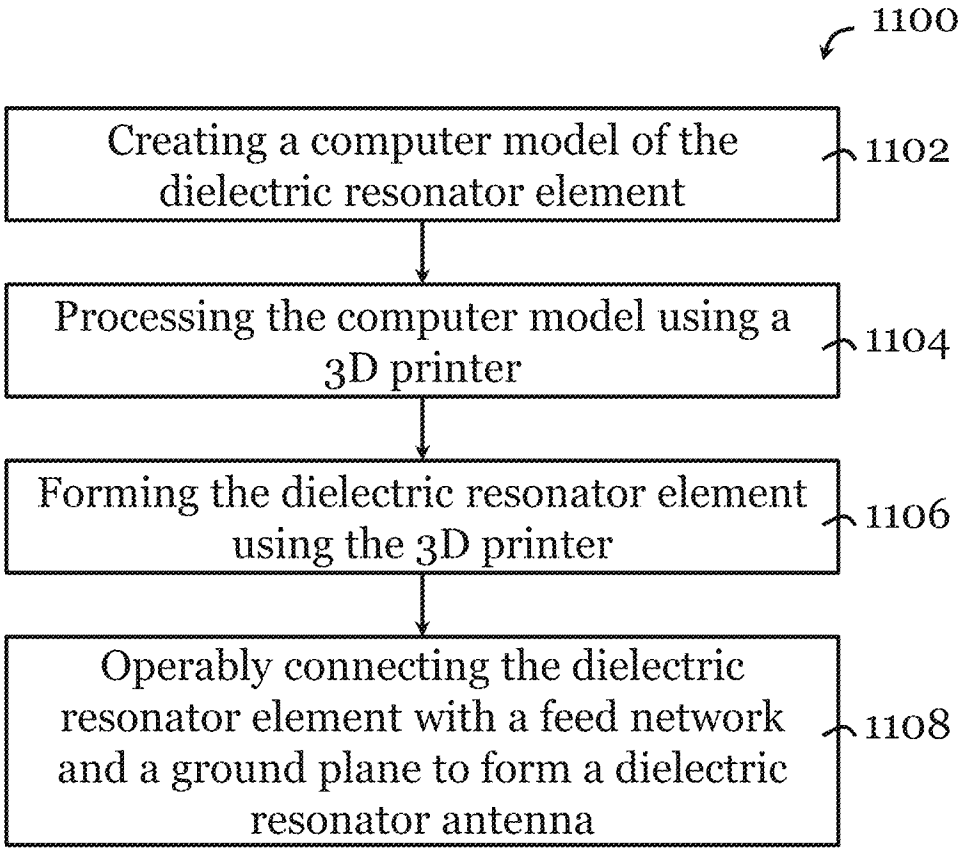
FIG. 11 is a flow chart showing a method for making a dielectric resonator antenna in one embodiment of the invention.

FIG. 11 shows a method 1100 for making the dielectric resonator antenna in one embodiment of the invention. The dielectric resonator antenna can be the dielectric resonator antenna 100, 100', 400 in FIGS. 1A to 1C and 4A to 4C. The method 1100 begins in step 1102, in which a computer model (e.g., CAD drawing) of the dielectric resonator element is created. Then, in step 1104, the computer model is loaded or otherwise accessed by (e.g., stored) a 3D printer, and the 3D printer processes the computer model. The 3D printer may be a fused deposition modeling (FDM) 3D printer, which can produce the element using one or more materials (e.g., ceramics). Subsequently, in step 1106, the 3D printer produces the dielectric resonator element based on the computer model. A dielectric resonator element is formed. After the dielectric resonator element is formed, in step 1108, the dielectric resonator element is operably connected with a feed network and a ground plane to form a dielectric resonator antenna. In one example, in step 1108, the dielectric resonator element is mounted on an aluminium plate which provides the ground plane. The feed network may be a SMA connector that can be mounted to the other side of the aluminium plate. The SMA connector has a coaxial feed probe that extends through the ground plane and be surrounded by the dielectric resonator element.

The dielectric resonator antenna of the above embodiments can be applied to an array design, to provide a dielectric resonator antenna array having a ground plane, multiple dielectric resonator elements operably coupled with the ground plane, and a feed network operably coupled with the dielectric resonator elements for exciting the dielectric resonator antenna array to provide a wideband omnidirectional response. The dielectric resonator elements each comprises a plurality of portions, including, at least, an innermost portion and an outermost portion arranged around the innermost portion. The innermost portion has a first effective dielectric constant. The outermost portion has a second, different effective dielectric constant. The dielectric resonator antenna array can be made similarly as the dielectric resonator antenna, using the method of FIG. 11. In particular the method 1100 in FIG. 11 can also be used to sequentially or simultaneously make multiple dielectric resonator elements, and the multiple dielectric resonator elements can be operably coupled with the ground plane and the feed network (e.g., individual sub-networks for respective dielectric resonator elements) to form the dielectric resonator antenna array.

The dielectric resonator antenna and the dielectric resonator antenna array of the above embodiments can be used in communication devices to provide large signal coverage. The communication devices may include wireless communication devices adapted for wireless communication (e.g., Wi-Fi routers adapted for Wi-Fi operations). The dielectric resonator antenna and the dielectric resonator antenna array of the above embodiments have a relatively low profile and are relatively compact. As a result they can be more readily used in miniaturised or small-scale systems or devices. In one specific embodiment above, the dielectric resonator antenna can be excited to provide three transverse magnetic modes, to provide relatively wide impedance bandwidth with stable omnidirectional radiation patterns. The relatively wide bandwidth may be advantageous in some applications.

It will be appreciated that where the methods and systems of the invention are either wholly implemented by computing system or partly implemented by computing systems then any appropriate computing system architecture may be utilized. This will include stand-alone computers, network computers, dedicated or non-dedicated hardware devices. Where the terms "computing system" and "computing device" are used, these terms are intended to include any appropriate arrangement of computer or information processing hardware capable of implementing the function described.

It will be appreciated by persons skilled in the art that numerous variations and/or modifications may be made to the invention as shown in the specific embodiments without departing from the scope of the invention as broadly described, so long as the dielectric resonator antenna can function as a wideband omnidirectional dielectric resonator antenna. Various possible options or alternatives have been non-exhaustively provided throughout the specification. The specifically described embodiments of the invention should therefore be considered in all respects as illustrative, not restrictive.

For example, the dielectric resonator element(s) can be made into different shape(s), form(s), dimension(s), etc., other than those illustrated. The dielectric resonator element(s) can be made with different materials with different effective dielectric constants, other than those illustrated. The dielectric resonator element(s) can be formed with only the innermost and the outermost portions, optionally with addition intermediate portion(s), of different shape(s), size(s), form(s), material(s), effective dielectric constant(s), etc. The intermediate portion(s) and the outermost portion can be concentric rings of any shape (e.g., concentric triangular rings, concentric rectangular rings, concentric polygonal rings, concentric rounded rings, concentric circular rings, etc.). The intermediate portion(s) need not be comprised or composed of grid cell units, and in the examples that the intermediate portion(s) are comprised or composed of grid cell units, the grid cell units need not be cubical. The dielectric resonator element(s) can be but need not be made with ceramic materials. The dielectric resonator element(s) can be but need not be additively manufactured. The dielectric constant distributions (of different portions) of the dielectric resonator elements can be other values other than those illustrated. The shape(s), form(s), dimension(s), etc., of the ground plane can vary. The shape(s), form(s), dimension(s), etc., of the feed network can vary. The dielectric resonator element(s) can be made using any 3D printing techniques (e.g., in one go), or made using conventional tooling/molding/machining methods. The 3D printing techniques can be not limited to the fused deposition modelling technique. The feed network need not be a probe-feed network but can be a feed network for a different form. The ground plane need not be made with aluminium, and can be other material(s). The values of the illustrated parameters can be different, dependent on applications. Depending on the configurations and specific deigns, the dielectric resonator antenna can be used in indoor applications, in outdoor applications, or in both indoor and outdoor applications.

The invention claimed is:

1. A dielectric resonator antenna, comprising:

a ground plane;

a dielectric resonator element operably coupled with the ground plane; and a feed network operably coupled with the dielectric resonator element for exciting the dielectric resonator antenna to provide a wideband omnidirectional response;

wherein the dielectric resonator element comprises a plurality of portions, the plurality of portions comprises:

an innermost portion having a first effective dielectric constant; and an outermost portion arranged around the innermost portion and having a second effective dielectric constant different from the first effective dielectric constant;

wherein the feed network is arranged to excite a plurality of transverse magnetic modes of the dielectric resonator antenna, and the plurality of transverse magnetic modes comprises $TM_{01\delta}$ mode, $TM_{02\delta}$ mode, and $TM_{03\delta}$ mode.

2. The dielectric resonator antenna of claim 1, wherein the innermost portion defines an axis and the outermost portion is arranged around the innermost portion about the axis.

3. The dielectric resonator antenna of claim 1, wherein the second effective dielectric constant is smaller than the first effective dielectric constant.

4. The dielectric resonator antenna of claim 1, wherein in plan view the innermost portion has a first outer contour and the outermost portion has a second outer contour; and wherein the first outer contour and the second outer contour are of a same type of shape and are of different sizes.

5. The dielectric resonator antenna of claim 1, wherein the innermost portion and the outermost portion have different air-filling ratios.

6. The dielectric resonator antenna of claim 1, wherein the innermost portion is generally prismatic.

7. The dielectric resonator antenna of claim 6, wherein the outermost portion is formed by a waffle structure with multiple grid cells.

8. The dielectric resonator antenna of claim 7, wherein the grid cells are defined by walls of the same thickness.

9. The dielectric resonator antenna of claim 1, wherein the innermost portion has a first height and the outermost portion has a second height larger than the first height.

10. The dielectric resonator antenna of claim 1, wherein the plurality of portions further comprises one or more intermediate portions arranged around the innermost portion and nested between each other and between the innermost portion and the outermost portion.

11. The dielectric resonator antenna of claim 10, wherein the respective effective dielectric constant of the one or more intermediate portions is smaller than the first effective dielectric constant and larger than the second effective dielectric constant.

12. The dielectric resonator antenna of claim 10, wherein the one or more intermediate portions include multiple nested intermediate portions each having a respective effective dielectric constant, and wherein the respective effective dielectric constants are different and are smaller than the first effective dielectric constant and larger than the second effective dielectric constant.

13. The dielectric resonator antenna of claim 12, wherein the respective effective dielectric constants decreases between each intermediate portion from the innermost portion to the outermost portion such that among all the intermediate portions the intermediate portion closest to the innermost portion has the largest effective dielectric constant and the intermediate portion closest to the outermost portion has the smallest effective dielectric constant.

14. The dielectric resonator antenna of claim 10, wherein the innermost portion, the one or more intermediate portions, and the outermost portion are generally concentric.

15. The dielectric resonator antenna of claim 14, wherein in plan view the innermost portion has a first outer contour, the outermost portion has a second outer contour, and the one or more intermediate portions each has a respective outer contour; and wherein the first outer contour, the second outer contour, and the respective outer contour are of a same type of shape and are of different sizes.

16. The dielectric resonator antenna of claim 11, wherein the one or more intermediate portions are each formed by a waffle structure with multiple grid cells.

17. The dielectric resonator antenna of claim 16, wherein the grid cells of the same intermediate portion are of generally the same size.

18. The dielectric resonator antenna of claim 12, wherein the one or more intermediate portions are each formed by a waffle structure with multiple grid cells;

wherein the grid cells of the same intermediate portion are defined by walls of the same thickness, which is different from the thickness of the walls of the outermost portions; and wherein the grid cells of different intermediate portions are defined by walls of a respective thickness different from that of the grid cells in the other intermediate portions.

19. The dielectric resonator antenna of claim 18, wherein the thickness of the walls of the grid cells increases from the outermost portion towards the innermost portion such that among all the outermost portion and the one or more intermediate portion, the walls of the grid cells of the outermost portion has the smallest thickness, and the walls of the grid cells of the intermediate portion furthest away from the outermost portion and closest to the innermost portion has the largest thickness.

20. The dielectric resonator antenna of claim 10, wherein the outermost portion has a height higher than that of the innermost portion and the one or more intermediate portions.

21. The dielectric resonator antenna of claim 10, wherein the outermost portion has a maximum height higher than that of the innermost portion and that of the one or more intermediate portions.

22. The dielectric resonator antenna of claim 1, wherein the dielectric resonator element is additively manufactured.

23. The dielectric resonator antenna of claim 1, wherein the dielectric resonator element is arranged on the ground plane.

24. The dielectric resonator antenna of claim 1, wherein the ground plane is made of aluminium.

25. The dielectric resonator antenna of claim 1, wherein the feed network comprises a SMA connector with a coaxial feed probe inserted through a hole in the ground plane and surrounded by the innermost portion.

26. A communication device comprising the dielectric resonator antenna of claim 1.

27. A dielectric resonator antenna array, comprising:

a ground plane;

a plurality of dielectric resonator elements operably coupled with the ground plane; and a feed network operably coupled with the plurality of dielectric resonator elements for exciting the dielectric resonator antenna array to provide a wideband omnidirectional response;

wherein the plurality of dielectric resonator elements each comprises a plurality of portions, the plurality of portions comprises:

an innermost portion having a first effective dielectric constant; and an outermost portion arranged around the innermost portion and having a second effective dielectric constant different from the first effective dielectric constant;

wherein the feed network is arranged to excite a plurality of transverse magnetic modes of the dielectric resonator antenna array, and the plurality of transverse magnetic modes comprises $TM_{01\delta}$ mode, $TM_{02\delta}$ mode, and $TM_{03\delta}$ mode.

28. The dielectric resonator antenna array of claim 27, wherein the feed network comprises a plurality of subnetworks each associated with a respective dielectric resonator element.

29. The dielectric resonator antenna array of claim 27, wherein the plurality of dielectric resonator elements are additively manufactured.

30. A dielectric resonator antenna, comprising:

a ground plane;

a dielectric resonator element operably coupled with the ground plane; and a feed network operably coupled with the dielectric resonator element for exciting the dielectric resonator antenna to provide a wideband omnidirectional response;

wherein the dielectric resonator element comprises a plurality of portions, the plurality of portions comprises:

an innermost portion having a first effective dielectric constant; and an outermost portion arranged around the innermost portion and having a second effective dielectric constant different from the first effective dielectric constant;

wherein the innermost portion is generally prismatic and the outermost portion is formed by a waffle structure with multiple grid cells.

31. The dielectric resonator antenna of claim 30, wherein the grid cells are defined by walls of the same thickness.

32. A dielectric resonator antenna, comprising:

a ground plane;

a dielectric resonator element operably coupled with the ground plane; and a feed network operably coupled with the dielectric resonator element for exciting the dielectric resonator antenna to provide a wideband omnidirectional response;

wherein the dielectric resonator element comprises a plurality of portions, the plurality of portions comprises:

an innermost portion having a first effective dielectric constant;

an outermost portion arranged around the innermost portion and having a second effective dielectric constant different from the first effective dielectric constant; and one or more intermediate portions arranged around the innermost portion and nested between each other and between the innermost portion and the outermost portion;

wherein the respective effective dielectric constant of the one or more intermediate portions is smaller than the first effective dielectric constant and larger than the second effective dielectric constant; and wherein the one or more intermediate portions are each formed by a waffle structure with multiple grid cells.

33. The dielectric resonator antenna of claim 32, wherein the grid cells of the same intermediate portion are of generally the same size.

34. A dielectric resonator antenna, comprising:

a ground plane;

a dielectric resonator element operably coupled with the ground plane; and a feed network operably coupled with the dielectric resonator element for exciting the dielectric resonator antenna to provide a wideband omnidirectional response;

wherein the dielectric resonator element comprises a plurality of portions, the plurality of portions comprises:

an innermost portion having a first effective dielectric constant;

an outermost portion arranged around the innermost portion and having a second effective dielectric constant different from the first effective dielectric constant; and one or more intermediate portions arranged around the innermost portion and nested between each other and between the innermost portion and the outermost portion;

wherein the one or more intermediate portions include multiple nested intermediate portions each having a respective effective dielectric constant, and wherein the respective effective dielectric constants are different and are smaller than the first effective dielectric constant and larger than the second effective dielectric constant;

wherein the one or more intermediate portions are each formed by a waffle structure with multiple grid cells;

wherein the grid cells of the same intermediate portion are defined by walls of the same thickness, which is different from the thickness of walls of the outermost portions; and wherein the grid cells of different intermediate portions are defined by walls of a respective thickness different from that of the grid cells in the outermost portion.

35. The dielectric resonator antenna of claim 34, wherein the thickness of the walls of the grid cells increases from the outermost portion towards the innermost portion such that among all the outermost portion and the one or more intermediate portions, the walls of the grid cells of the outermost portion has the smallest thickness, and the walls of the grid cells of the intermediate portion furthest away from the outermost portion and closest to the innermost portion has the largest thickness.

* * * * *